US005193664A

United States Patent [19]

Ives

[11] Patent Number: 5,193,664

[45] Date of Patent: Mar. 16, 1993

[54] UNIVERSAL ACCESS SWITCH

[75] Inventor: Fredrick C. Ives, McSherrystown, Pa.

[73] Assignee: Inventio AG, Hergiswil NW, Switzerland

[21] Appl. No.: 803,533

[22] Filed: Dec. 9, 1991

[51] Int. Cl.[5] ..... H01H 27/10

[52] U.S. Cl. ..... 200/43.01; 200/293; 200/295; 200/43.011; 70/461; 70/DIG. 30

[58] Field of Search ..... 200/43.08, 43.04, 43.01, 200/296, 294, 293, 295, 43.11, 333, 61.64; 70/447, 448, 451, 461, DIG. 30; 248/906, 27.1; 361/417, 419, 420; 174/57; 220/3.7

[56] References Cited

U.S. PATENT DOCUMENTS

| | | | |
|---|---|---|---|
| 1,774,934 | 9/1930 | Mangin | 248/906 X |
| 2,286,898 | 6/1942 | Cover | 248/906 X |
| 2,794,083 | 5/1957 | Moretti | 200/296 X |
| 3,573,344 | 4/1971 | Snyder | 174/57 |
| 3,928,716 | 12/1975 | Marrero | 174/57 |
| 4,098,423 | 7/1978 | Marrero | 248/906 X |
| 4,558,193 | 12/1985 | Test | 70/DIG. 30 |
| 4,673,149 | 6/1987 | Grote et al. | 248/906 X |
| 4,689,456 | 8/1987 | Martin | 200/43.08 |
| 4,952,760 | 8/1990 | Wilson | 200/333 X |
| 4,992,635 | 2/1991 | Westcott | 200/294 X |
| 5,084,596 | 1/1992 | Borsh et al. | 174/57 X |
| 5,098,046 | 3/1992 | Webb | 248/906 X |

FOREIGN PATENT DOCUMENTS 2856337 7/1980 Fed. Rep. of Germany .

*Primary Examiner*—Henry J. Recla
*Assistant Examiner*—Glenn T. Barrett
*Attorney, Agent, or Firm*—Sandler Greenblum & Bernstein

[57] ABSTRACT

The key-operated switch enables realization of a switch construction which is extensively independent of the dimensions of standard cylinder locks and mounting thereof independent of the surroundings. A switch housing open at one side comprises side walls, a floor, a lower portion and an upper portion. Longitudinal slots provided at the side walls extend parallel to wide side edges of the side walls and serve for guiding first fastening screws. A housing cover member which fits in the housing opening and having bevelled corners and flaps is displaceable throughout a predetermined distance along the longitudinal slots. At the operator side of the key-operated switch the housing cover member carries a collar connected by second fastening screws with such housing cover member. A throughpass opening is provided at the housing cover member through which piercingly extends a standard cylinder lock attached at the collar. At the operator side of the key-operated switch the cylinder lock is surrounded by the collar and at the housing side is operatively connected with a switch insert member. The dimensions of the throughpass opening are selected such that after removal of the second fastening screws the switch insert member can be removed from the housing at the operator side.

6 Claims, 2 Drawing Sheets

UNIVERSAL ACCESS SWITCH

BACKGROUND OF THE INVENTION

1. Field of the Invention

The present invention relates to a new and improved construction of an universal access switch, also referred to herein as a key-operated switch, which is of the type comprising a housing open at one side and provided with a cover member for the housing and a conventional cylinder lock for actuating a switch insert or switch insert member capable of performing a switch function.

2. Discussion of the Background and Material Information

German Published Patent Application No. 2,856,337, published Jul. 10, 1980, discloses a key-operated switch comprising a housing having a removable cover in which there is fastened by means of an attachment lug or nose member a cylinder lock containing a rotatable locking bit or latch. At the-side-of the operator or user there is arranged at the removable cover a seal and a cover plate, each of which is provided with a throughpass opening for the cylinder lock. The cover, seal and cover plate are connected with the housing by threaded bolts or screws extending through four respective aligned or registering fastening or attachment holes.

A drawback of this prior art key-operated switch is that the thickness of the seal and cover plate must coincide with the part of the cylinder lock protruding out of the cover at the side of the operator. A strict correlation or accommodation is required between the seal and cover plate with respect to the cylinder lock, since there are employed conventional cylinder locks for key-operated switches and depending upon the manufacturer there are encountered different dimensions of the cylinder lock.

SUMMARY OF THE INVENTION

Therefore, with the foregoing in mind, it is a primary object of the present invention to provide an improved construction of an universal access switch or key-operated switch which is not afflicted with such shortcoming or drawback of the prior art.

Another and more specific object of the present invention aims at providing an improved modular construction of a universal access switch or key-operated switch which is extensively independent of the dimensions of the cylinder lock thereof.

Still a further noteworthy object of the present invention concerns the provision of an improved key-operated switch which can be universally employed in conjunction with cylinder locks of different dimensions.

Now in order to implement these and still further objects of the present invention, which will become more readily apparent as the description proceeds, the key-operated switch of the present development is manifested, among other things, by the features that the housing has a housing opening, and the cover member is insertable into or fits in the housing opening and is displaceable in the direction of the housing depth. The cover member supports a collar at the side of the operator and this collar surrounds the cylinder lock. Angled flap or leg members are provided for the cover member in order to guide such cover member. These angled flap or leg members are substantially flat and disposed substantially parallel to side walls of the housing and contain bores. Fastening means, such as fastening screws or bolts which are guided in longitudinal slots of the side walls of the housing engage with the bores of the angled flap or leg members.

According to a further aspect of the present invention, the fastening means define first fastening means and the bores define first bores. The cover member of the housing is provided with a throughpass opening for receiving the cylinder lock and about which there are arranged second bores for securing the collar at the cover member, and second fastening means, such as fastening screws or bolts engage with the second bores.

Still further, the cylinder lock extends through the throughpass opening and is operatively connected with the switch insert. Such cylinder lock is arranged at the collar.

A further feature of the present invention contemplates that the dimensions of the throughpass opening are such that following removal of the second fastening means the switch insert can be removed from the housing at the side of the operator or user.

One of the more notable advantages which can be realized with the present invention resides in the fact that there can be devised key-operated switches using different dimension cylinder locks, and there can be beneficially employed cover plates having standardized throughpass openings and different wall thicknesses. A further significant advantage is the ability to flushly align the cylinder locks of such key-operated switches at the cover plates exposingly mounted at the outside of wall plaster or the like independent of the thickness of the wall plaster, especially when concealingly mounting the key-operated switches. Yet a further cogent advantage of the present invention is the ability to install such type key-operated locks in already existing structural elements, such as linings or coverings of structures, door frames and the like which render unnecessary the use of a cover plate.

BRIEF DESCRIPTION OF THE DRAWINGS

The invention will be better understood and objects other than those set forth above, will become apparent when consideration is given to the following detailed description thereof. Such description makes reference to the annexed drawings wherein.

Figure 1:
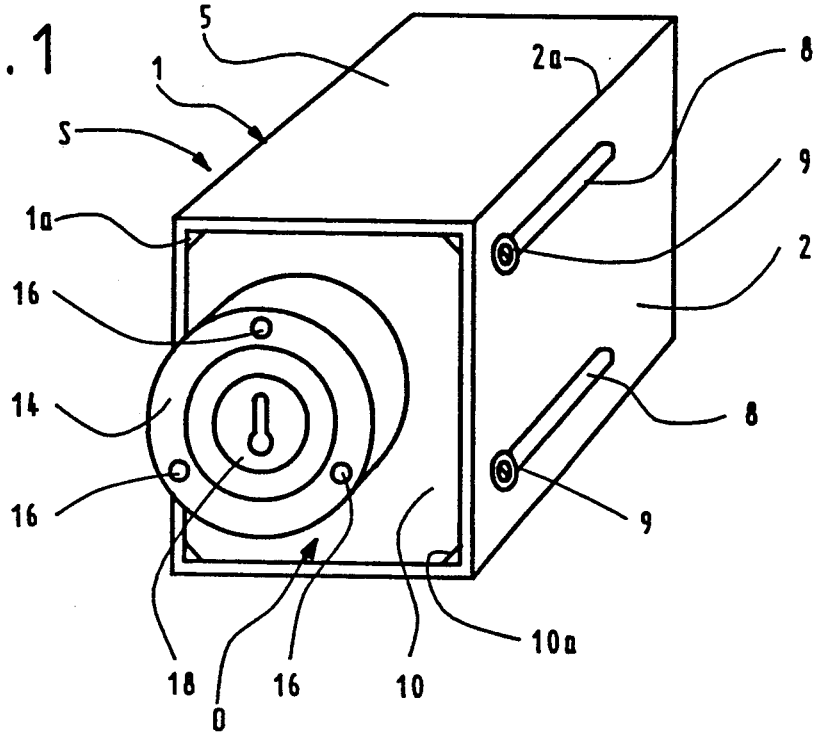
FIG. 1 is a perspective view of a universal access switch or key-operated switch constructed according to the present invention.
Figure 2A:
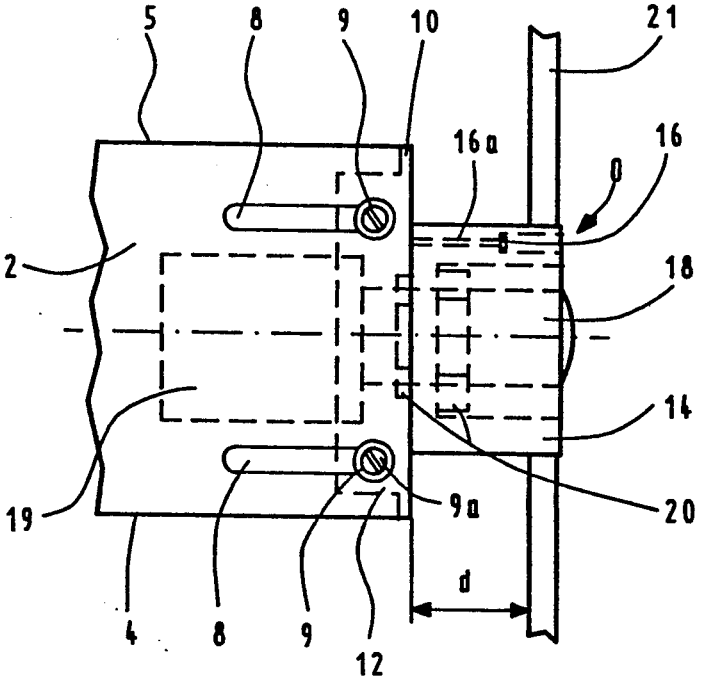
Figure 2B:
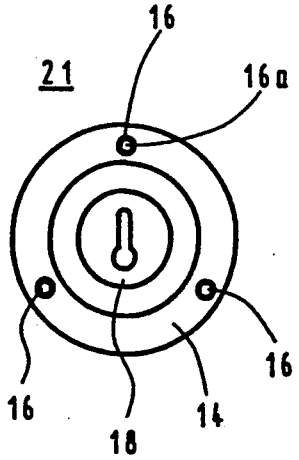

FIG. *2a* is a fragmentary side view of the key-operated switch of FIG. 1 depicting details of the cylinder lock thereof mounted in a collar;

FIG. *2b* is a front view of the arrangement of FIG. *2a;*

Figure 3:
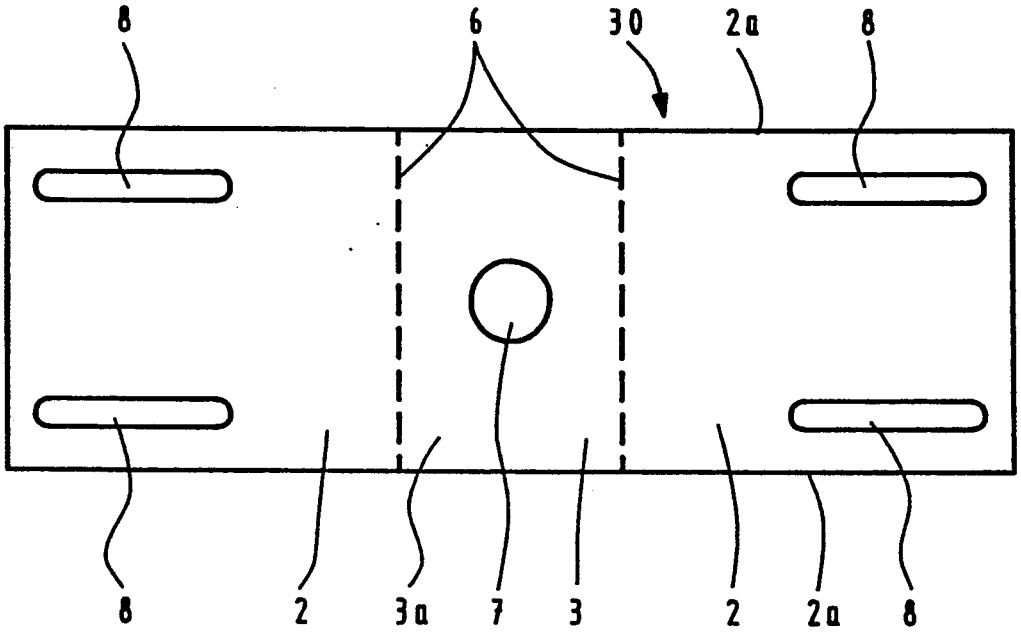
Figure 4:
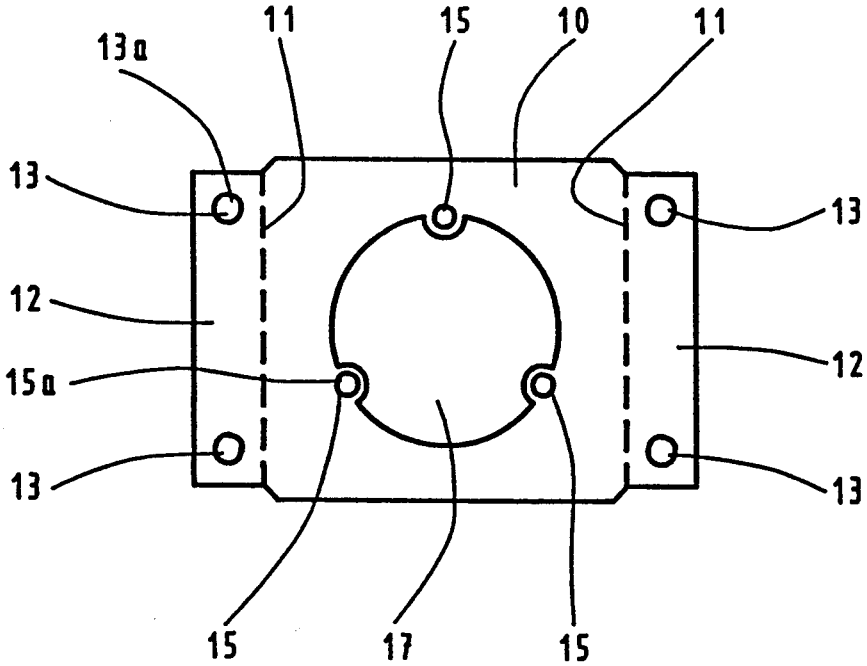

FIG. 3 is a development of a part of the housing of the key-operated lock and which forms the side walls and floor of such housing; and FIG. 4 is a development of the housing cover member of the key-operated switch and which carries the collar.

DETAILED DESCRIPTION OF THE PREFERRED EMBODIMENTS

Describing now the drawings, it is to be understood that only enough of the construction of the universal access switch or key-operated switch has been depicted therein, in order to simplify the illustration, as needed for those skilled in the art to readily understand the underlying principles and concepts of the present invention.

Turning attention to FIGS. 1 to 4 of the drawings, there is depicted therein an exemplary embodiment of key-operated switch S comprising a housing 1 which is open at one side, namely the operator or user side 0, due to the presence of a housing opening, generally indicated by reference character 1*a*. This housing 1 is composed of substantially parallel side walls 2, a floor or base 3 defined by a rear wall 3*a*, a lower part or lower wall 4, and an upper part or upper wall 5. With particular reference to FIG. 3, in order to form such housing 1 a one-piece part or element 30 is bent at bend lines or edges 6, so that there is produced a substantially U-shaped housing part from such one-piece part or element 30 and which contains the side walls 2 having longitudinal or elongate slots 8 and the housing floor or base 3. The lower part 4 and the upper part 5 are connected, for example, by welding with the side walls 2 and housing floor or base 3.

Continuing, in the housing floor or base 3 there is provided a connection hole or opening 7 for the insertion of a switch connection cable. The aforementioned longitudinal slots 8 extend in the depth direction of the housing 1 substantially parallel to wide side edges 2*a* of the side walls 2 of such housing 1 and serve to piercingly receive and guide first or bolts 9*a*. A housing cover member 10 receivable in the housing opening 1*a* has bevelled corners 10*a* and angled or bent flaps or legs 12 located at second bending edges or lines 11. At these angled flaps or legs 12 there are formed first bores or holes 13 containing threading, generally indicated by reference character 13*a*. The angled flaps or legs 12 together with the threaded bores or holes 13 are disposed in spaced relationship from the two longitudinal slots 8 provided at each of the housing side walls 2. Additionally, these angled flaps or tabs 12 of the housing cover member 10 are connected with the first fastening screws or bolts 9*a* threaded into the threading 13*a* of the first bores or holes 13, so that such housing cover member 10 can be selectively displaced in the depth direction of the housing along the longitudinal slots 8 through the distance d (see FIG. 2*a*).

At the operator side 0 of the key-operated switch S the housing cover member 10 supports a collar or collar member 14 which is connected by second fastening means 16, such as threaded screws or bolts 16*a*, with the housing cover member 10. These threaded screws or bolts 16*a* engage with threading, generally indicated in FIG. 4 by reference character 15*a*, of second bores or holes 15 formed at the housing cover member 10. Inwardly of the second bores or holes 15 there is provided a throughpass opening or hole 17 for the reception of a conventional cylinder lock 18 secured by a nut member 20 or equivalent fastening expedient at the collar 14. At the operator side 0 of the key-operated switch S this cylinder lock 18 is surrounded by the collar 14 and at the side of the housing I such cylinder lock 18 is operatively connected with a switch insert member 19. The dimensions of the throughpass opening or hole 17 are selected such that following removal of the second fastening screws or bolts 16*a* this switch insert member 19 can be removed out of the housing I at the operator side 0 of the key-operated switch S. Finally, and with attention specifically invited to FIG. 2, it is here remarked that reference numeral 21 designates a cover plate or when there is not used a cover plate then a door frame, a wall lining or covering or the like.

While there are shown and described present preferred embodiments of the invention, it is distinctly to be understood the invention is not limited thereto, but may be otherwise variously embodied and practiced within the scope of the following claims.

What is claimed is:

1. A key-operated switch comprising:

a housing having a housing opening and defining a housing depth;

the housing comprising side walls containing longitudinally extending slots, thereby defining a longitudinal direction;

a cover member provided for the housing, the cover member being inserted into the housing opening and being displaceabale in the longitudinal direction within the housing;

a switch insert member for performing a switch function positioned within the housing;

a cylinder lock for actuating the switch insert member;

a collar located on and supported by the cover member, said switch insert member and said cylinder lock being supported on said cover member by said collar;

the collar surrounding the cylinder lock;

angled flap members connected to the cover member for guiding the cover member within the housing;

the angled flap members being disposed substantially parallel to the side walls of the housing and containing bores for securing the cover member to the housing; and fastening means guided in the longitudinal slots of the side walls of the housing and engaging with the bores of the angled flap members.

2. The key-operated switch according to claim 1, wherein:

said fastening means comprise fastening screws.

3. The key-operated switch according to claim 1, wherein:

the fastening means define first fastening means;

the bores define first bores;

the cover member of the housing being provided with a throughpass opening for receiving the cylinder lock and about which there are arranged second bores for securing the collar to the cover member; and second fastening means engaging with the second bores.

4. The key-operated switch according to claim 3, wherein:

said second fastening means comprise fastening screws.

5. The key-operated switch according to claim 3, wherein:

the throughpass opening has dimensions such that following removal of the second fastening means the switch insert member can be removed from the housing through said throughpass opening.

6. The key-operated switch according to claim 1, wherein:

the cover member of the housing is provided with a throughpass opening for receiving the cylinder lock and about which there are arranged bores for securing the collar to the cover member;

the cylinder lock extending through the throughpass opening and being operatively connected with the switch insert member; and the cylinder lock being arranged at the collar.

* * * * *